United States Patent [19]

Nishida

[11] Patent Number: 4,688,508

[45] Date of Patent: Aug. 25, 1987

[54] SMALL-SIZED MARINE CRAFT WITH SHELL CONSTRUCTION HAVING HAND GRIPS

[75] Inventor: Hiroshi Nishida, Miki, Japan

[73] Assignee: Kawasaki Jukogyo Kabushiki Kaisha, Kobe, Japan

[21] Appl. No.: 756,606

[22] Filed: Jul. 19, 1985

[30] Foreign Application Priority Data

Jul. 23, 1984 [JP] Japan ..... 59-152584

[51] Int. Cl.[4] ..... B63H 11/02

[52] U.S. Cl. ..... 114/362; 440/38; 114/270

[58] Field of Search ..... 114/270, 362, 364, 315, 114/343; 440/38; 441/65, 73; 296/71; 16/115

[56] References Cited

U.S. PATENT DOCUMENTS

| | | | |
|---|---|---|---|
| D. 241,025 | 8/1976 | Jacobson | D12/314 |
| 1,074,133 | 9/1913 | Neustaedter | 16/115 |
| 3,584,704 | 6/1971 | Eckmann | 114/270 |
| 3,827,392 | 8/1974 | Jones | 114/270 |
| 3,921,239 | 11/1975 | Sovia et al. | 441/65 |
| 4,194,460 | 3/1980 | Sato et al. | 440/89 |

*Primary Examiner*—Joseph F. Peters, Jr.
*Assistant Examiner*—Edwin L. Swinehart
*Attorney, Agent, or Firm*—Leydig, Voit & Mayer

[57] ABSTRACT

A small-sized marine craft has a shell with a deck, an engine room formed in the bow portion of the hull, an engine mounted in the engine room, a propulsion device on the stern of the hull, a steering handle device on the top wall of the engine room, a rear part of the deck provides a seat for a rider, and a grip at the rear wall of the engine room for easy gripping and pulling by a rider climbing up the marine craft or by a fellow rider during a tandem ride.

4 Claims, 7 Drawing Figures

SMALL-SIZED MARINE CRAFT WITH SHELL CONSTRUCTION HAVING HAND GRIPS

BACKGROUND OF THE INVENTION

1. Field of the Invention

The present invention relates to a small-sized marine craft for use in marine sports or for leisure purposes, which is suited to running about the water areas usually near the shore, under the control of a rider on the stern portion of the shell who grips a steering handle bar standing up from the bow portion of the shell.

2. Description of the Related Art

In general, a small-sized marine craft of the kind described has an engine mounted in an engine room formed in the bow portion of the shell and a propulsion means provided at the stern portion of the same. The rider stands up or sits on a deck portion formed on the shell to the rear of the engine room and grips the steering handle bar on the bow portion of the shell.

The shell has a breadth which is substantially equal to or slightly greater than the shoulder breadth of a rider. The rider is seated on a rear portion of the deck.

The propulsion means may be a propeller or a pumped water jet. Where a pumped water jet is used, the marine craft can be steered by changing the direction of the jet.

This type of marine craft has an excellent running performance and is capable of running at high speeds of up to approx. 50 km/h. However, the rider often accidentally falls from the running marine craft.

Also this type of marine craft, the deck formed on the shell has generally smooth surfaces without substantial projections from the view point of safety, so that only the steering handle bar is available for the rider to hold on to. Therefore, a rider who has accidentally fallen into the water can hardly climb up onto the marine craft.

SUMMARY OF THE INVENTION

Accordingly, an object of this invention is to provide a small-sized marine craft which provides a means by which the rider in the water easily climbs up onto the marine craft.

The small-sized marine craft in accordance with the invention has a shell with a deck, an engine room formed in the bow portion of the shell, an engine mounted in the engine room, a propulsion means mounted on the stern portion of the shell and drivingly connected to the engine, and a steering handle device standing up from a bow portion. The rear part of the deck has a seat portion. A grip means is attached to the rear wall of the engine room.

According to this arrangement, the rider who has accidentally fallen into the sea can easily climb up onto the marine craft by gripping and pulling the grip means.

For easier climbing, the seat portion is formed of an upward protrusion on the rear deck such as to have a tail end which slopes rearwardly and downwardly.

DESCRIPTION OF THE PREFERRED EMBODIMENTS

Figure 1:
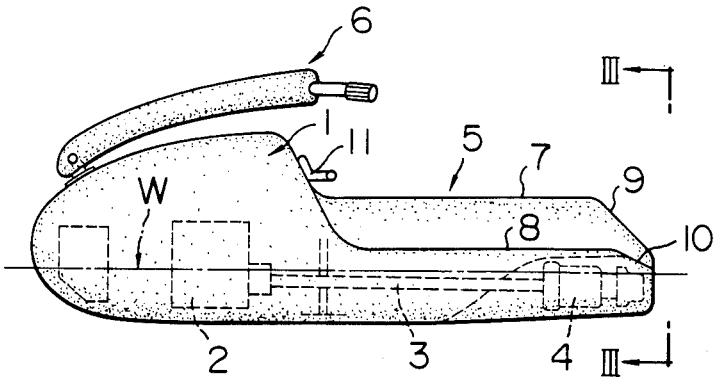
FIG. 1 is a side elevational view of a first embodiment of a small-sized marine craft in accordance with the invention.
Figure 2:
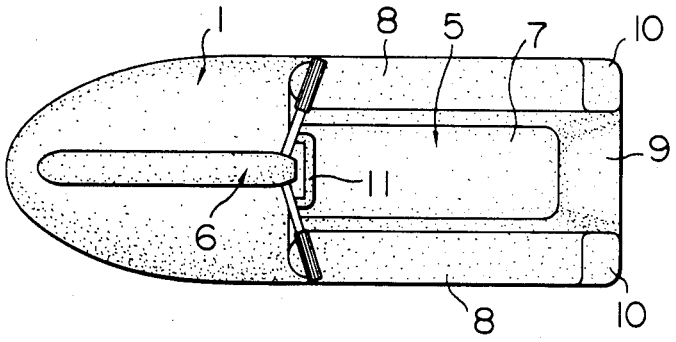
FIG. 2 is a plan view of the small-sized marine craft shown in FIG. 1.
Figure 3:
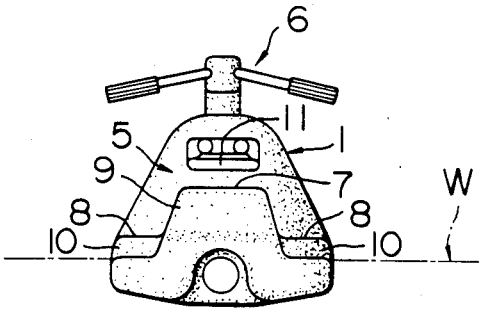
FIG. 3 is a rear elevational view of the small-sized marine craft shown in FIG. 1.

Referring to FIGS. 1 to 3, a first embodiment of a small-sized marine craft of the invention has a shell in the front portion of which is formed a hermetic engine room 1 which accomodates an engine 2. A propulsion means 4 provided on the stern portion of the shell is driven by the engine 2 through a driving shaft 3. A rear deck 5 provides a seat for a rider and a fellow rider.

A steering handle device generally designated at a numeral 6 is provided on a bow portion of the marine craft. The rider controls the marine craft and supports himself by means of the steering handle device.

The rear deck 5 has a central protrusion which constitutes a projecting seat portion 7, with step portions 8 formed on both sides of the seat portion 7.

The tail end 9 of the seat portion 7 slopes downwardly and rearwardly. Although in this embodiment the tail end 9 slopes substantially at 45° over the entire breadth thereof, the slope angle and the breadth of the sloping area can be selected suitably as desired. In the illustrated embodiment, the tail ends 10 of the step portions 8 also slope rearwardly and downwardly.

In FIGS. 1 and 3, the dot-and-dash line W represents the water line.

According to the invention, a grip means in the form of a U-shaped hand-hold member 11 made of, for example, a rubbery flexible material is attached to the rear wall of the engine room 1. The grip means 11 is preferably made of a rubber or a plastic material having a Shore hardness of 30 to 60 (JIS A) so that it can easily be deformed resiliently when contacted by the rider. In the described embodiment, the U-shaped frame 11 constituting the grip means is attached by means of, for example, bolts to the central portion of the rear wall of the engine room 1 above the front end of the seat portion 7.

The frame 11 provides a hand-hold which can be gripped by the rider when he is trying to climb up the marine craft, or by a fellow rider so as to give a stable support for him.

According to this embodiment shown in FIGS. 1 to 3 having the grip means constituted by the U-shaped frame 11 on a mid portion of the rear wall of the engine room, the rider in the water can easily climb up onto the marine craft by holding the U-shaped frame 11. The sloping tail end 9 of the seat portion allows the rider in the water to easily lift up his body over the stern so as to straddle the seat portion 7. The climbing and straddling is further facilitated by the sloping tail ends 10 of the step portions 8.

If there is a fellow rider, he can hold on to the U-shaped frame 11 so as to embrace the rider's body. The fellow rider, therefore, can support himself as if he is integral with the rider, so that the rider can stably and easily steer the marine craft in case of a tandem ride.

Although in the illustrated embodiment the grip means is constituted by a single U-shaped frame 11 provided on the central portion of the rear wall of the engine room, this is only illustrative and the invention does not exclude the use of a pair of similar U-shaped frames attached to left and right portions of the rear wall of the engine room. In such a case, the grip means may be positioned below the level of the top of the seat portion 7. The grip means, which is constituted by a U-shaped frame 11 in the illustrated embodiment, can have various other forms easy to grip such as a semi-circular frame, rings and so forth, or may be constituted by a knob with an enlarged head portion. It is also possible to provide a suitable anti-slip surface on the grip means.

In the embodiment shown in FIGS. 1 to 3, the grip means of a flexible material is protruded from the rear wall of the engine room. The grip means, however, may be received in a recess formed at a suitable portion on the deck.

Figure 4:
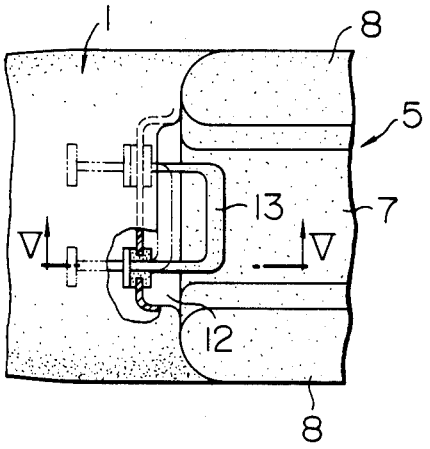
FIG. 4 is a plan view of an essential portion of a second embodiment of the small-sized marine craft in accordance with the invention.
Figure 5:
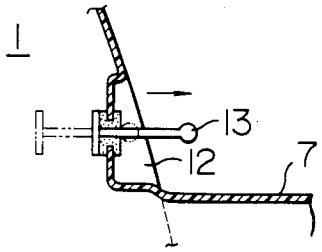
FIG. 5 is a sectional view taken along the line V—V of FIG. 4.
Figure 6:
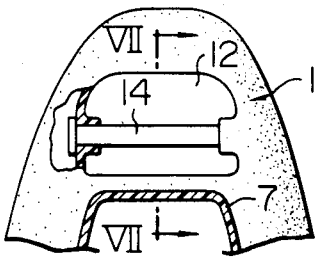
FIG. 6 is a fragmentary sectional rear elevational view of an essential portion of a third embodiment of the small-sized marine craft in accordance with the invention.
Figure 7:
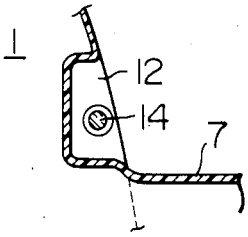
FIG. 7 is a sectional view taken along the line VII—VII of FIG. 6.

FIGS. 4 and 5 in combination show another embodiment in which the grip means is usually received in a recess, while FIGS. 6 and 7 show still another embodiment of the same type.

Referring to FIGS. 4 and 5, a recess 12 is formed in the rear wall of the engine room, and a grip means in the form of a substantially U-shaped grip bar 13 having two opposing sides is extractably received in the recess 12. More specifically, the grip bar 13 can be extracted by the rider to a position shown by solid line, but is stored in the recess 12 as indicated by two-dot-and-dash line when it is not used.

Since the grip bar 13 used in this embodiment is usually received in the recess 12, it may be made of a rigid material, although a flexible soft material can be used equally.

Other portions of this embodiment are materially identical to those of the embodiment shown in FIGS. 1 to 3. In FIGS. 4 and 5, therefore, the same reference numerals are used to denote the same parts or members as those appearing in FIGS. 1 to 3. It will be clear that the embodiment explained in connection with FIGS. 4 and 5 produces the same effects as those attained by the first embodiment.

Referring now to FIGS. 6 and 7 showing still another embodiment, the grip means is constituted by a grip bar 14 which is attached to the rear wall of the engine room 1 so as to extend across a recess 12 formed in this wall. The grip bar 14 is usually made of a rigid material, although a soft flexible material may be used satisfactorily.

The portions of this embodiment other than those specifically mentioned above are materially identical to those of the embodiment explained in connection with FIGS. 1 to 3, so that the same reference numerals are used to denote the same parts or members as those appearing in FIGS. 1 to 3, and detailed description of such parts or members is omitted. It will be seen that the embodiment shown in FIGS. 6 and 7 offers the same advantages as those offered by the first embodiment.

Although the described embodiments of marine craft have a seat portion 7 which is constituted by a central protrusion on the rear deck, it will be clear to those skilled in the art that the marine craft of the invention may be of such a type that both sides of the marine craft are protruded upwardly so as to form a riding floor between these walls.

The steering handle device used in the illustrated embodiments, which includes a boom extending rearwardly along the upper wall of the engine room 1, may be substituted by other types of steering device such as those having a steering handle bar or a steering wheel attached to the top end of a rotatable column.

Other changes and modifications are possible without departing from the scope of the invention which is limited solely by the appended claims.

What is claimed is:

1. A small-sized marine craft comprising:

a shell including a deck having a seat portion on a rear part of said deck;

an engine room formed in a bow portion of said shell and having an upright rear wall;

an engine mounted in said engine room;

propulsion means provided on a stern portion of said shell and drivingly connected to said engine;

a steering handle means provided on an upper side of said engine room; and a grip means including an elongated member projecting from said rear wall of said engine room providing a hand-hold member to assist in climbing on board the craft, said grip means being U-shaped with, two opposing sides extending from the rear wall of said engine room.

2. A small-sized marine craft comprising:

a shell including a deck having a seat portion on a rear part of said deck;

an engine room formed in a bow portion of said shell and having an upright rear wall in which a recess is formed;

an engine mounted in said engine room;

propulsion means provided on a stern portion of said shell and drivingly connected to said engine;

a steering handle means provided on an upper side of said engine room; and a grip means extractably received in said rear wall recess including an elongated member projecting from said recess providing a hand-hold member to assist in climbing on board the

3. A small-sized marine craft comprising:

a shell including a deck having a seat portion on a rear part of said deck;

an engine room formed in a bow portion of said shell and having an upright rear wall in which a recess is formed;

an engine mounted in said engine room;

propulsion means provided on a stern portion of said shell and drivingly connected to said engine;

a steering handle means provided on an upper side of said engine room; and a grip means constituted by a grip bar which is extended substantially horizontally across said rear wall recess and secured to said rear wall of said engine room providing a hand-hold member to assist in climbing on board the craft.

4. A small-sized marine craft according to claim 3, in which said grip means is constituted by a hard material.

* * * * *